US009648958B2

(12) United States Patent
Pectol

(10) Patent No.: US 9,648,958 B2
(45) Date of Patent: May 16, 2017

(54) FOLDABLE STOOL WITH HANDLE AND LOCK

(71) Applicant: Mity-Lite, Inc., Orem, UT (US)

(72) Inventor: Matthew Pectol, Fruit Heights, UT (US)

(73) Assignee: Mity-Lite, Inc., Orem, UT (US)

( * ) Notice: Subject to any disclaimer, the term of this patent is extended or adjusted under 35 U.S.C. 154(b) by 0 days.

(21) Appl. No.: 15/134,663

(22) Filed: Apr. 21, 2016

(65) Prior Publication Data

US 2016/0316915 A1 Nov. 3, 2016

Related U.S. Application Data

(60) Provisional application No. 62/153,977, filed on Apr. 28, 2015.

(51) Int. Cl.
*A47C 9/10* (2006.01)

(52) U.S. Cl.
CPC ..... *A47C 9/10* (2013.01)

(58) Field of Classification Search
CPC ..... A47C 9/00; A47C 9/10; A47C 9/08
See application file for complete search history.

(56) References Cited

U.S. PATENT DOCUMENTS 1,379,129 A * 5/1921 Sejnoha ..... A47C 9/10 108/148
1,420,095 A * 6/1922 Gutter ..... A47C 4/10 297/44
1,963,835 A * 6/1934 Deland ..... A47C 9/10 297/44
4,630,861 A * 12/1986 Henschel ..... A47C 4/08 108/124
4,700,914 A * 10/1987 Cheetham ..... A47C 9/10 108/150
5,044,690 A * 9/1991 Torrey ..... A47C 4/283 108/119
7,377,583 B1 * 5/2008 Anthony ..... A47C 4/08 297/44
7,828,377 B2 * 11/2010 Grace ..... A47C 4/283 297/16.2
8,661,991 B2 * 3/2014 Eveleth ..... A47B 3/08 108/115
8,875,840 B2 * 11/2014 Chancler ..... A47C 9/10 182/33
2009/0261643 A1 * 10/2009 Kay ..... A47C 9/10 297/335
2015/0083522 A1 * 3/2015 Chancler ..... A47C 12/00 182/152
2016/0309903 A1 * 10/2016 Huang ..... A47C 12/00

* cited by examiner

*Primary Examiner* — Philip Gabler
(74) *Attorney, Agent, or Firm* — Thorpe, North & Western, LLP

(57) ABSTRACT

A foldable stool comprises legs pivotally coupled together and a seat pivotally coupled to and carried by the legs. The seat is split into a pair of seat portions that is pivotally coupled together. A handle is formed in, and is coextensive with, one of the pair of seat portions. The handle is pivotal with respect to another of the seat portions. A lock positively holds the handle with respect to the another of the seat portions when the pair of seat portions are in a seat orientation.

20 Claims, 9 Drawing Sheets

FOLDABLE STOOL WITH HANDLE AND LOCK

PRIORITY CLAIM

Priority is claimed to copending U.S. Provisional Patent Application Ser. No. 62/153,977, filed Apr. 28, 2015, which is hereby incorporated herein by reference in its entirety.

BACKGROUND

Field of the Invention

The present invention relates generally to a foldable stool.

Related Art

Stools can be provided for a person to sit upon. Stepping stools have been proposed that fold or collapse automatically when lifted.

SUMMARY OF THE INVENTION

It has been recognized that it would be advantageous to develop a stool that can be easily stored, and provide a safe and supplemental seating surface for a person to sit upon. In addition, it has been recognized that it would be advantageous to develop a stool that can lock into a position for safety.

The invention provides a foldable stool comprising legs pivotally coupled together, and pivoting with respect to one another about a leg pivot axis located at an intermediate a length of the legs. The legs pivot between: 1) an open orientation, in which bottoms and tops of the legs are spaced-apart from one another; and 2) a closed orientation, in which the bottoms and the tops of the legs are adjacent one another. A seat is pivotally coupled to and carried by the legs. The seat is split into a pair of seat portions. The pair of seat portions is pivotally coupled together, and pivots with respect to one another about a seat axis. The pair of seat portions pivot between: 1) a seat orientation, in which outer seating surfaces of the pair of seat portions are co-planar; and 2) a folded orientation, in which the pair of seat portions face in opposite directions. A handle is formed in, and is coextensive with, one of the pair of seat portions. The handle is pivotal with respect to another of the seat portions. A lock positively holds the handle with respect to the another of the seat portions when the pair of seat portions are in the seat orientation.

In accordance with a more detailed aspects of the present invention, the lock can be formed between the handle of the one of the pair of seat portions and the another of the pair of seat portions. The lock can be carried by the handle, and can engage the another of the pair of seat portions when the pair of seat portions are in the seat orientation. The lock can comprise a flexible tab extending from the handle. A tooth can extend from the tab intermediate a length of the tab. The tooth can engage the second seat portion in the seat orientation to lock the pair of seat portions from pivoting when the pair of seat portions are in the seat orientation. The tab can be flexible to displace the tooth away from the second seat portion under an applied force. The tab can be resilient to return the tooth into engagement with the second seat portion upon removal of the applied force when the pair of seat portions are in the seat orientation. A distal end of the tab can extend beyond the tooth to form a finger engagement configured to receive the applied force.

In accordance with a more detailed aspect of the present invention, the stool can comprise a non-linear part disposed between the pair of seat portions, and extending non-linearly between the pair of seat portions when the pair of seat portions are in the seat orientation. A protrusion in the first seat portion can extend into an indentation in the second seat portion when the pair of seat portions are in the seat orientation. An aperture can be formed in the protrusion, and can define the handle.

In accordance with a more detailed aspect of the present invention, the stool can comprise a lip extending from the indentation, upon which the protrusion can rest in the seat orientation. A pair of arms can extending from the first seat portion, upon which the second seat portion can rest in the seat orientation.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Figure 1C:
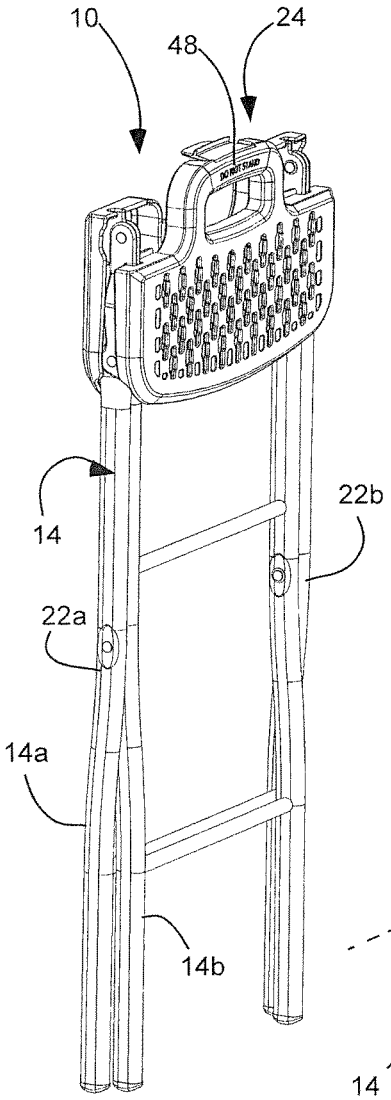
FIG. 1*c* is a perspective view of the stool of FIG. 1, shown with the seat in a folded orientation and the pairs of legs in a closed orientation.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

The invention presents a stool (or seat or seat-type stool) that is foldable and selectively configurable in a seat orientation and a folded orientation. Thus, the stool can be configured for sitting, or for storage. The stool or its legs can be sized for a person so sit upon in the seat orientation, and thus can have a seat with an elevational height of 23-29 inches. In addition, the stool can be folded for storage, and can have a folded width of less than 5 inches. The seat can be split or segmented into seat segments that can pivot with respect to one another between the seat and folded orientation. In one aspect, the stool (and the seat segments) can be locked into the seat orientation for safety with a lock. The lock can be carried by the seat and can be positioned under the seat to resist inadvertent contact. In addition, the lock can be self-activating or self-locking as the stool reconfigures from the folded orientation to the seat orientation. Thus, one seat segment can automatically lock to another seat segment in the seat orientation. A handle can be integrally formed in the seat. The lock can be carried by the handle and can be positioned such that a user can grasp the handle and deactivate the lock simultaneously with a single hand.

As illustrated in FIGS. 1*a*-14, a foldable stool, indicated generally at 10, in an example implementation in accordance with the invention is shown. The stool has legs 14 pivotally coupled together and pivoting with respect to one another about a leg pivot axis 18. The leg pivot axis is located at an intermediate point of each of the legs, or intermediate a length of the legs. The legs 14 can include first and second pairs of legs 14*a* and 14*b*. The legs in each pair can be affixed together and can pivot together as a set. The legs in each pair of legs can be spaced-apart from one another so that the legs are located substantially at an outer width or profile of the stool (or seat). In one aspect, the first and second pairs of legs 14*a* and 14*b* can be pairs of outer and inner legs, respectively, with the pair of inner legs passing inside of the pair of outer legs. The legs can be formed of metal, such as aluminum or steel, and can be formed of tubing. Each of the pairs of legs can have one or more cross-braces or spars extending between each of the legs in the pair of legs. Adjacent legs from each of the pair of legs can be pivotally joined together by a fastener, such as a rivet or bolt. The fasteners can define a pivot axel or pair of pivot axels, and can define the leg pivot axis 18. Adjacent legs can form leg assemblies so that the stool has a pair of leg assemblies 22*a* and 22*b*, with each leg in the leg assembly pivotally coupled to the other, and with the pair of leg assemblies joined together. The legs have bottoms that can have feet carried thereby. The feet can be formed of plastic to resist marring and/or noise. The feet can be coupled to the bottoms of the legs by insertion into the tubes.

Figure 1A:
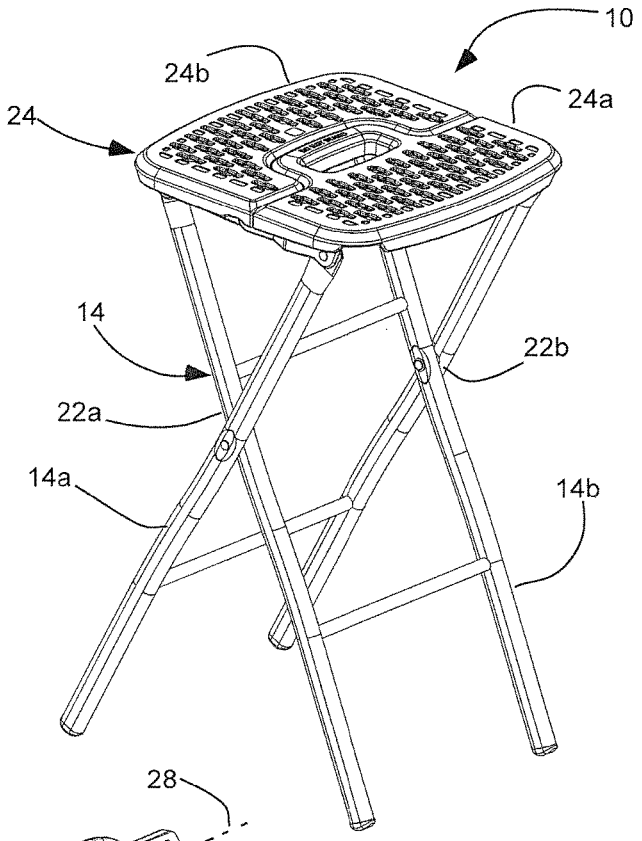
FIG. 1*a* is a perspective view of a stool in accordance with an embodiment of the present invention, shown with a seat having pair of seat portions in a seat orientation and pairs of inner and outer legs in an open orientation.
Figure 1B:
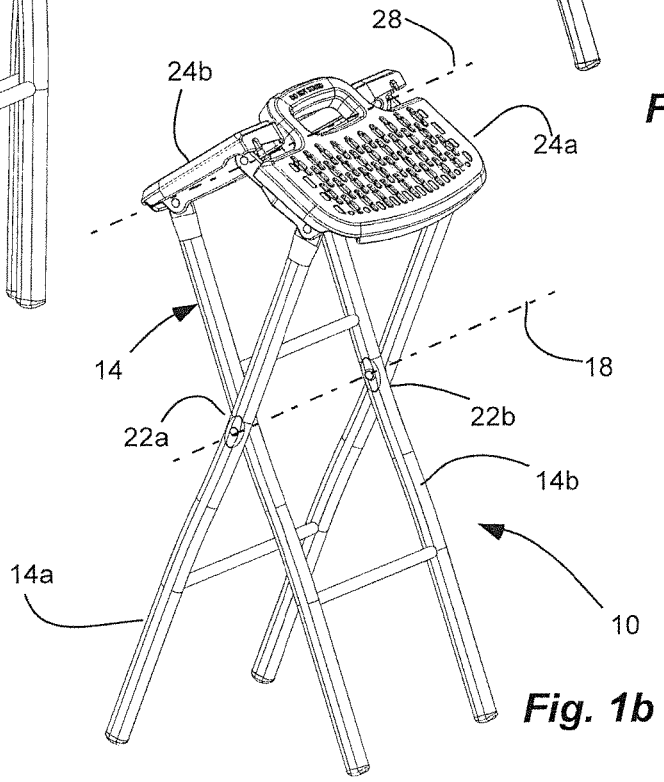
FIG. 1*b* is a perspective view of the stool of FIG. 1, shown with the seat and the pairs of legs in an intermediate orientation.
Figure 2C:
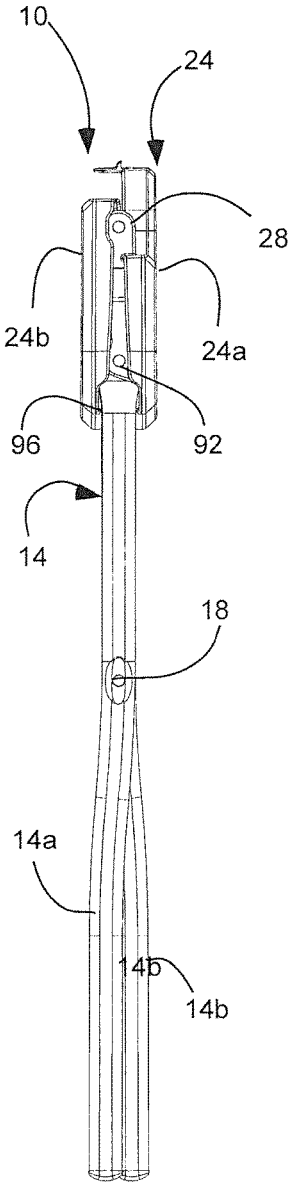
FIG. 2*c* is a side view of the stool of FIG. 1, shown with the seat in the folded orientation and the pairs of legs in the closed orientation.
Figure 2A:
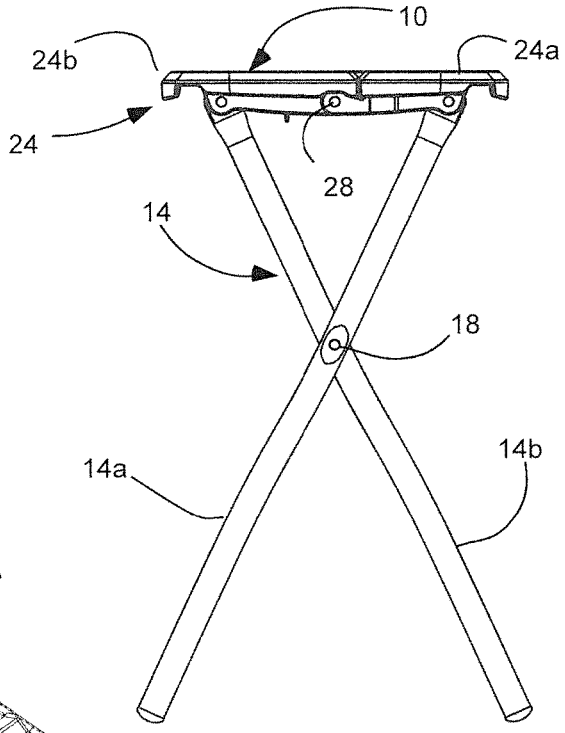
FIG. 2*a* is a side view of a stool of FIG. 1, shown with the seat in the seat orientation and the pairs legs in the open orientation.
Figure 2B:
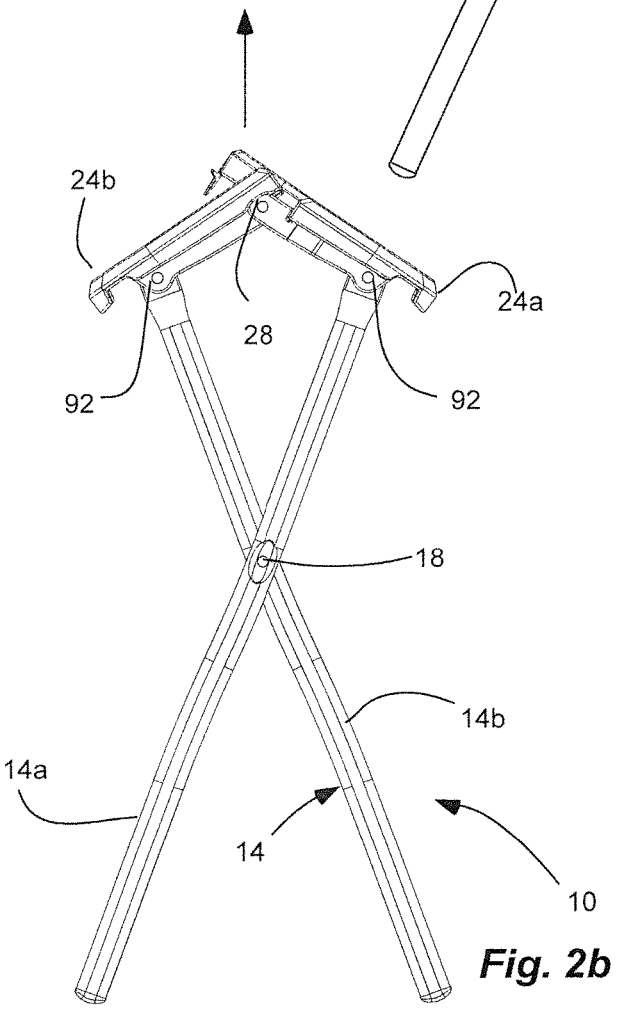
FIG. 2*b* is a side view of the stool of FIG. 1, shown with the seat and the pairs of legs in the intermediate orientation.
Figure 3:
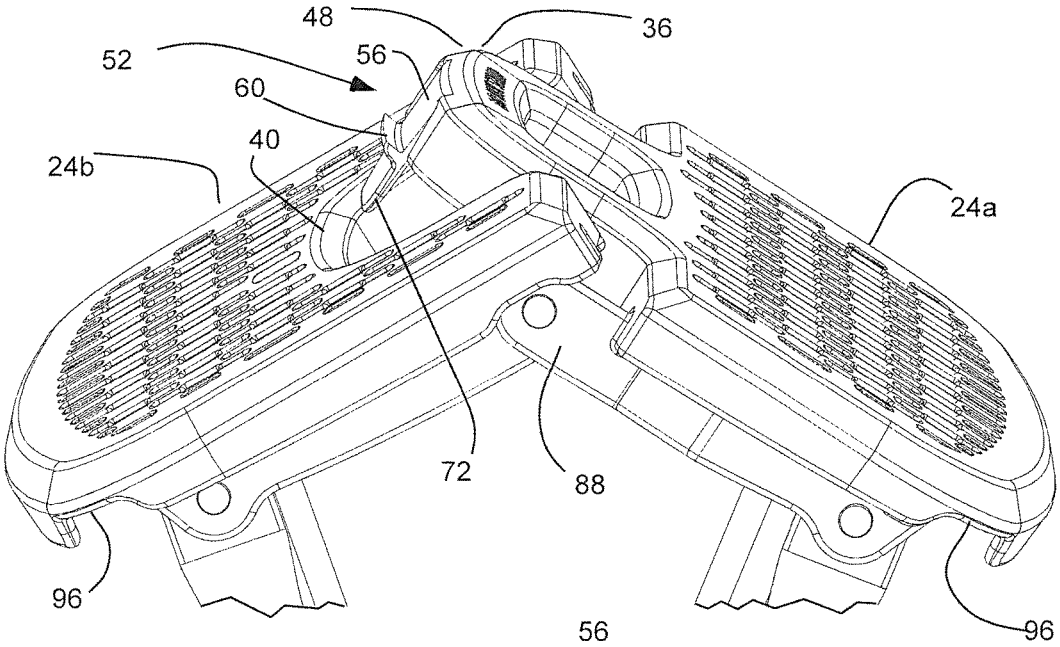
FIG. 3 is a partial perspective view of the stool of FIG. 1, shown with the seat in the intermediate orientation.
Figure 4:
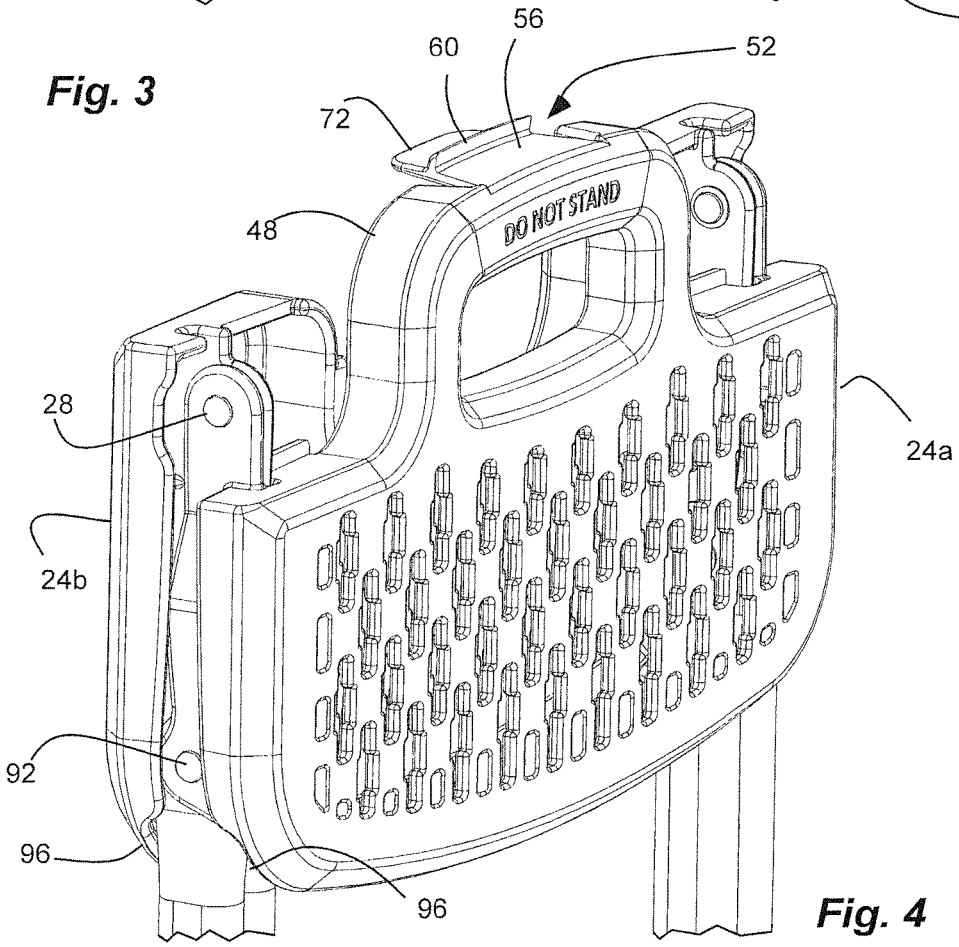
FIG. 4 is a partial perspective view of the stool of FIG. 1, shown with the seat in the folded orientation.
Figure 5:
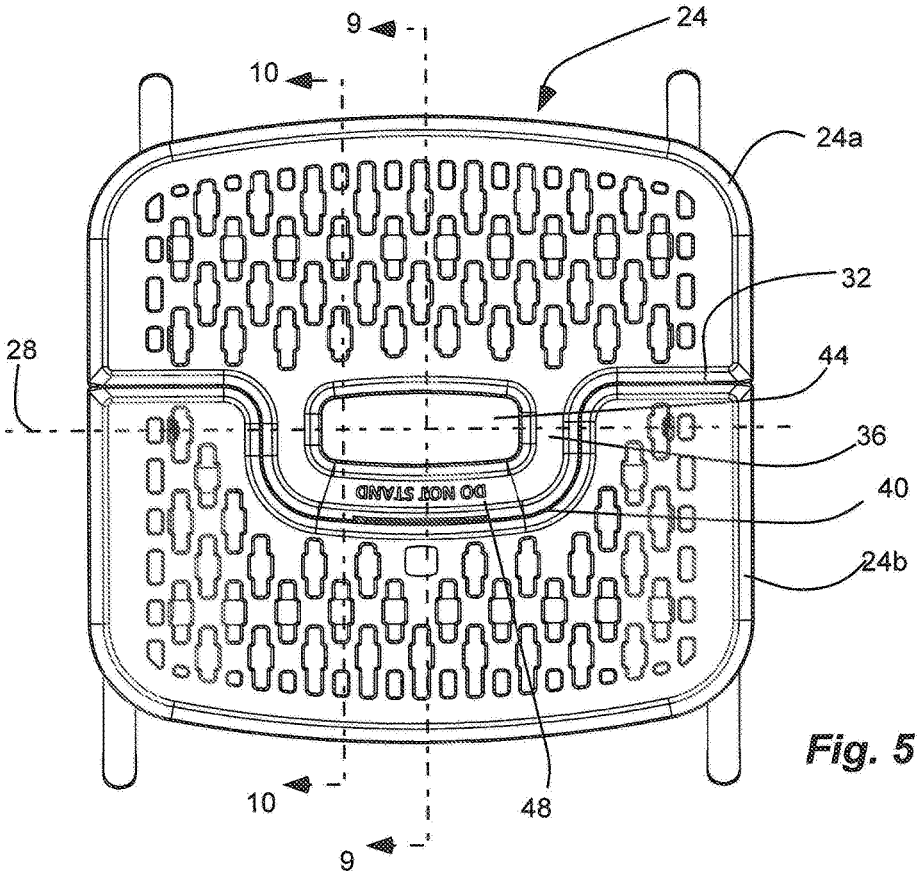
FIG. 5 is a top view of the stool of FIG. 1, shown with the seat in the seat orientation.
Figure 6:
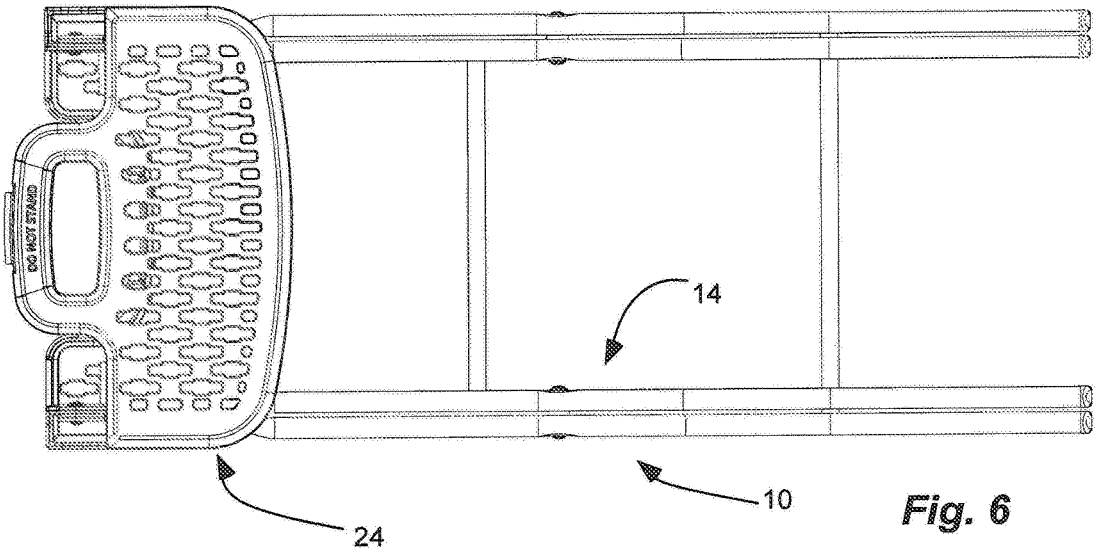
FIG. 6 is a front view of the stool of FIG. 1, shown with the seat in the folded orientation.
Figure 7A:
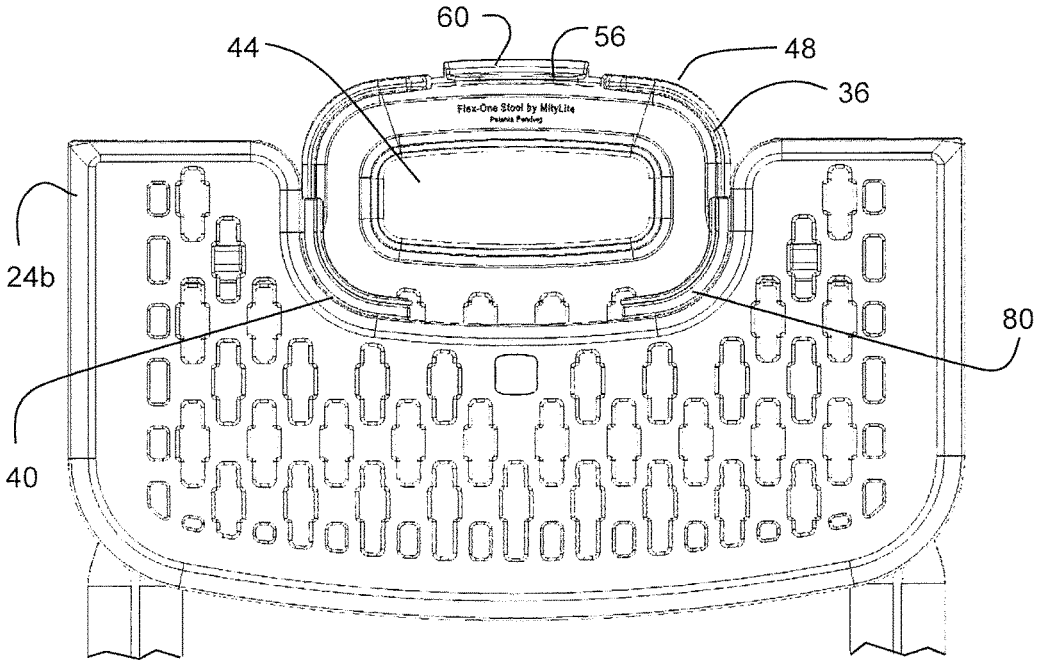
FIG. 7*a* is a partial rear view of the stool of FIG. 1, shown with the seat in the folded orientation.
Figure 7B:
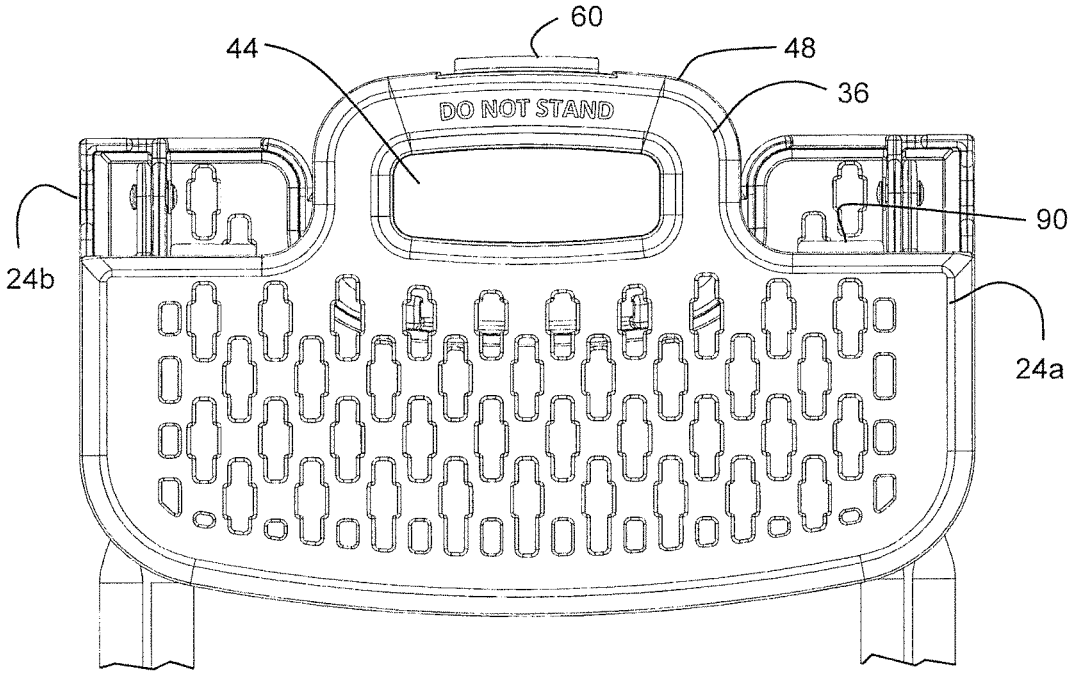
FIG. 7*b* is a partial front view of the stool of FIG. 1, shown with the seat in the folded orientation.
Figure 8A:
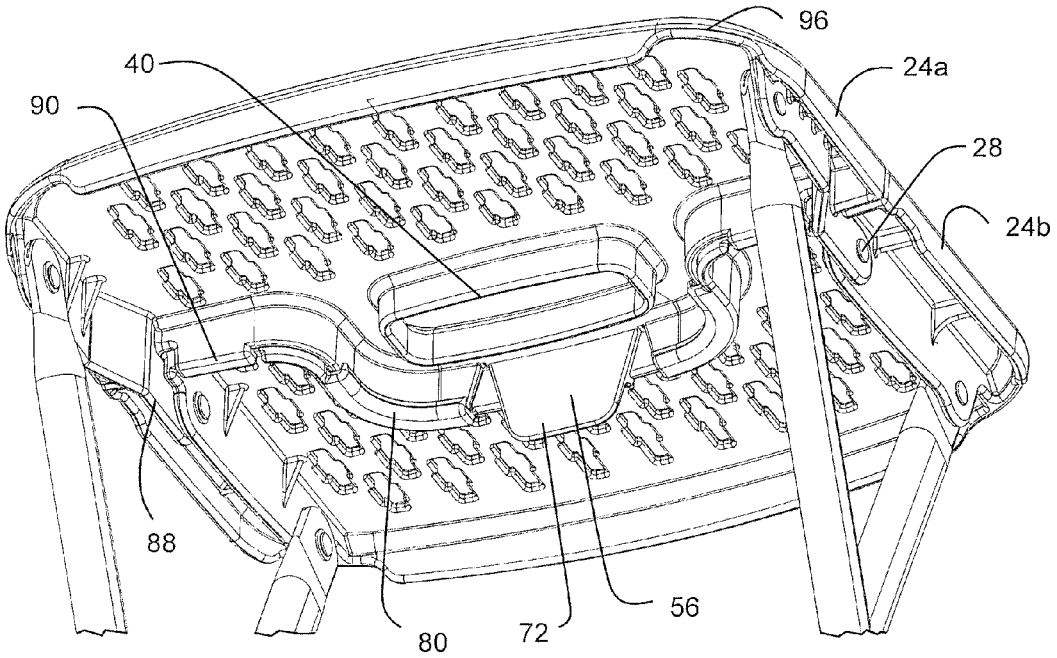
FIG. 8*a* is a partial bottom perspective view of the stool of FIG. 1, shown with the seat in the seat orientation.
Figure 8B:
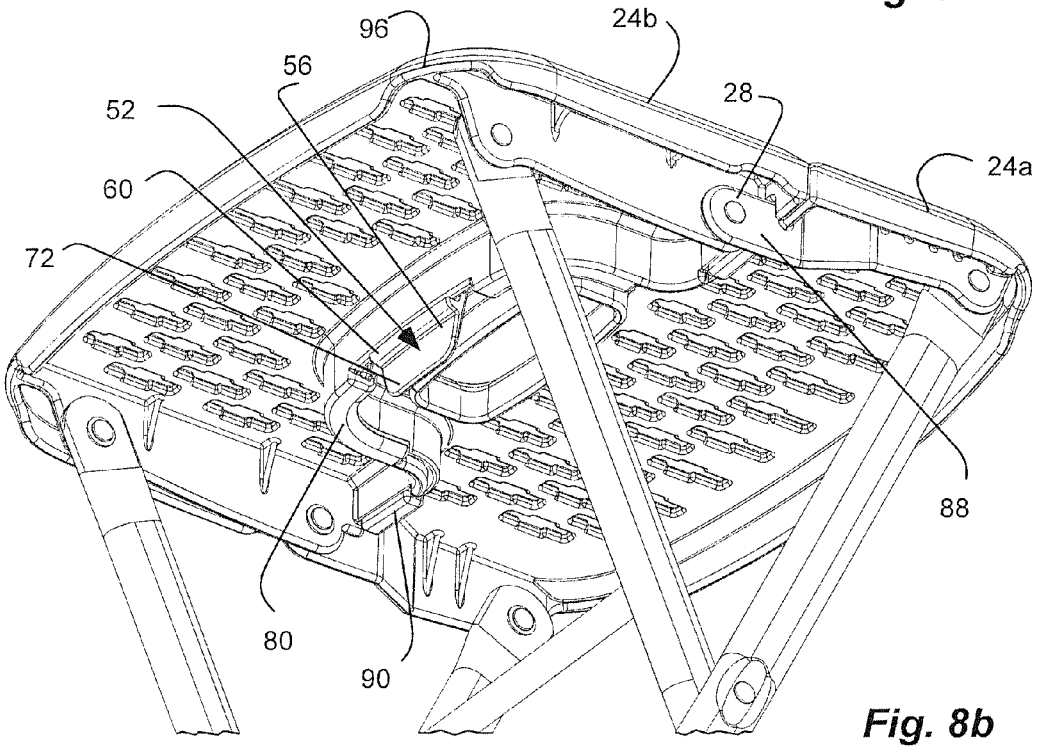
FIG. 8*b* is a partial bottom perspective view of the stool of FIG. 1, shown with the seat in the seat orientation.
Figure 9:
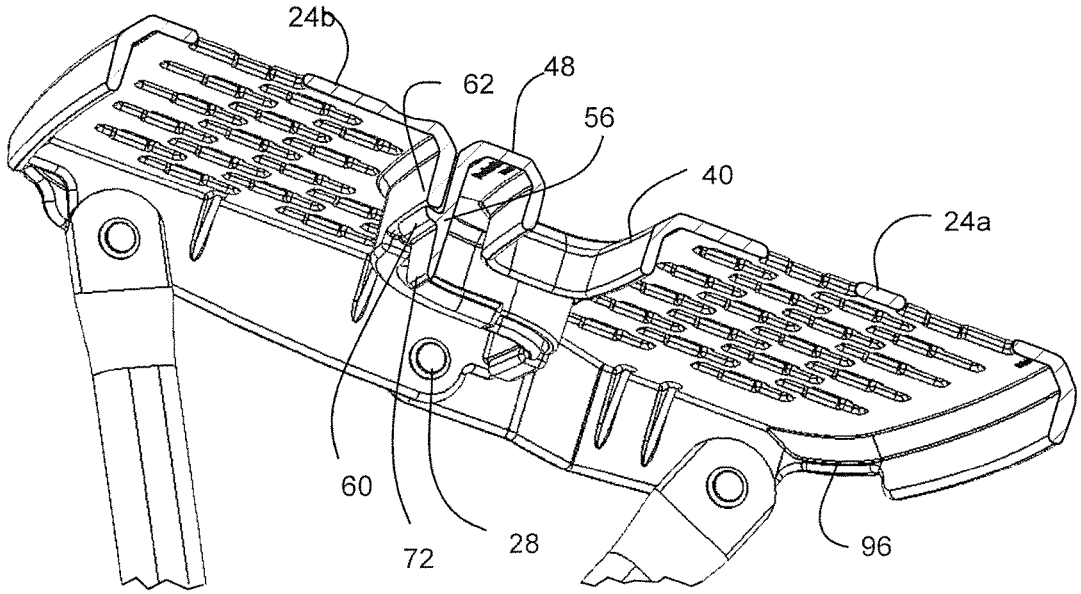
FIG. 9 is a partial cross-sectional view of the stool of FIG. 1, taken along line 9 in FIG. 5.
Figure 10:
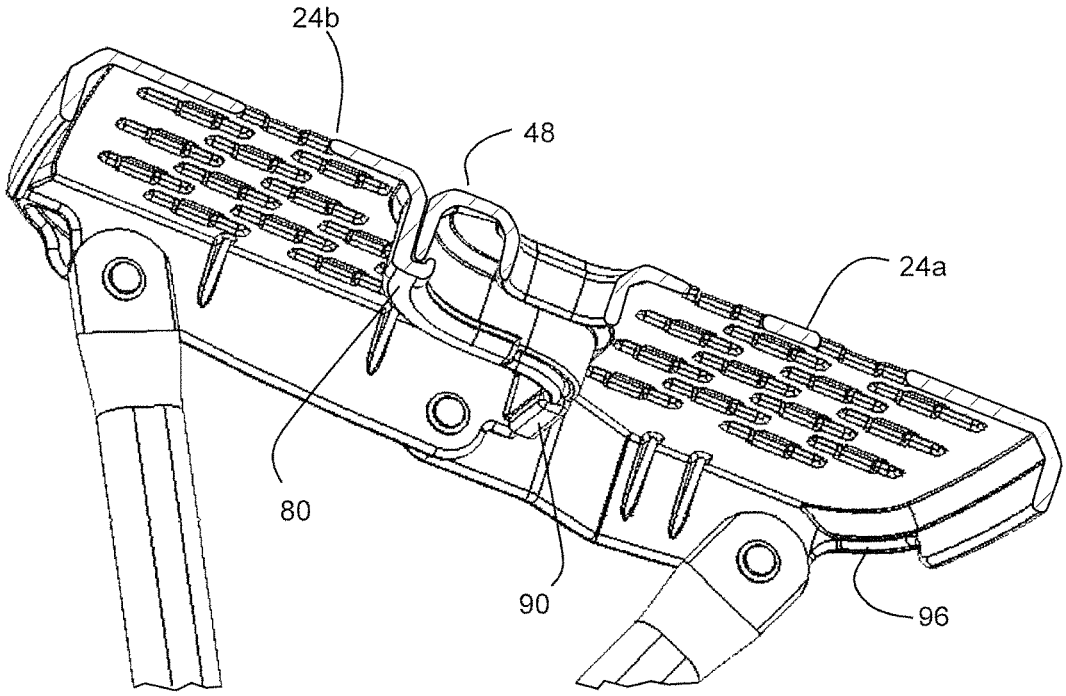
FIG. 10 is a partial cross-sectional view of the stool of FIG. 1, taken along line 10 in FIG. 5.
Figure 11:
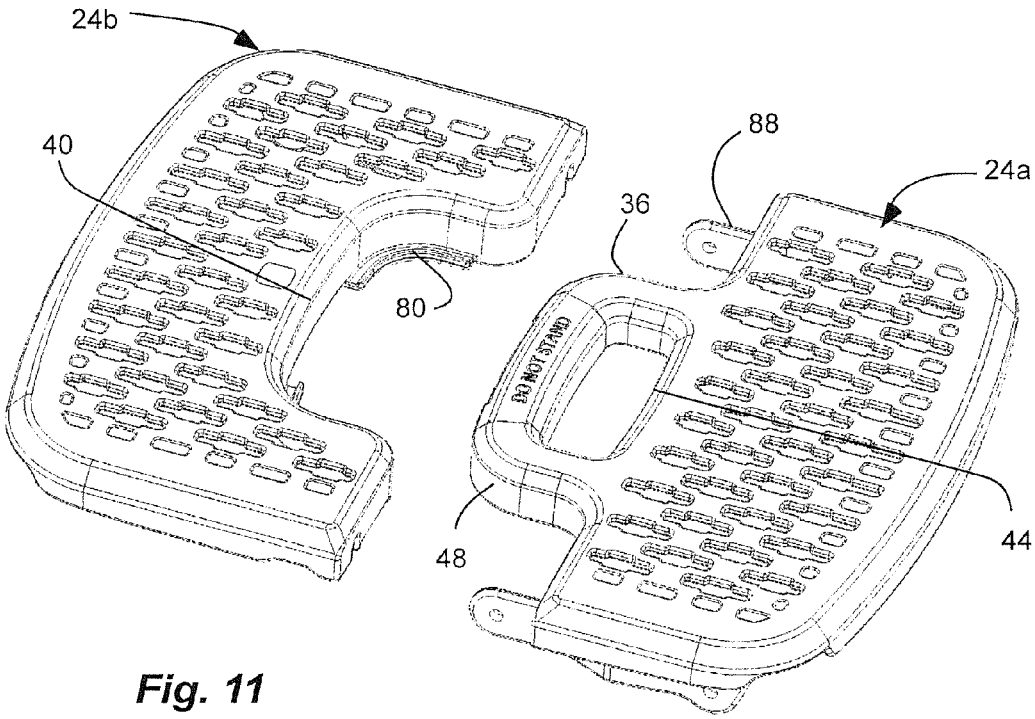
FIG. 11 is a top exploded perspective view of the seat of the stool of FIG. 1.
Figure 12:
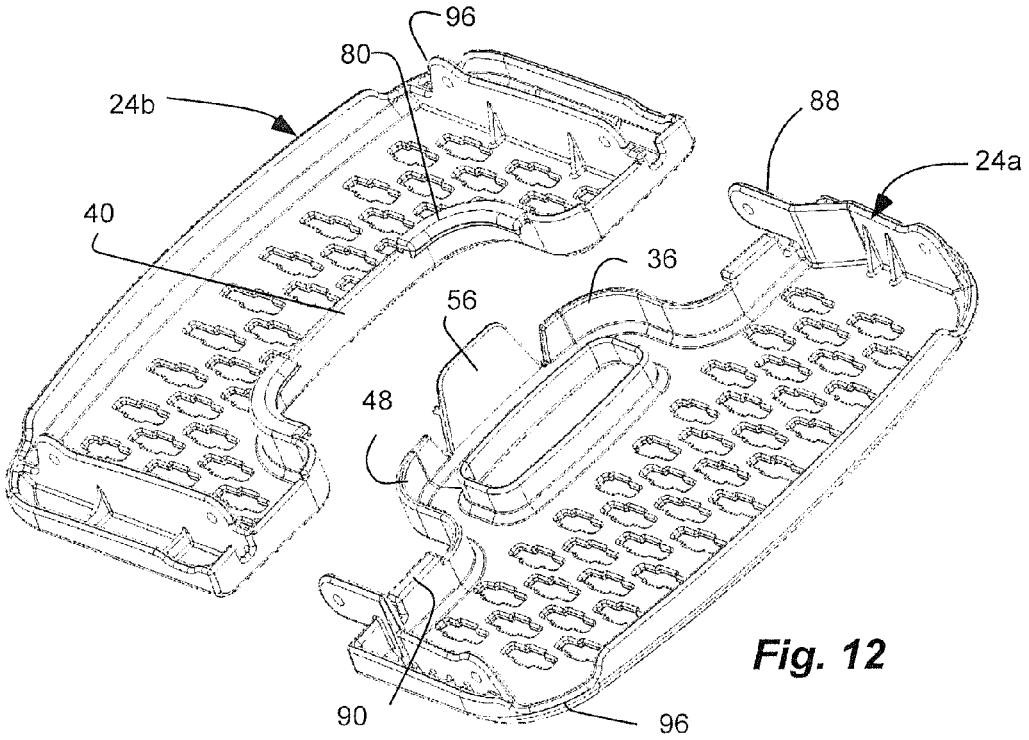
FIG. 12 is a bottom exploded perspective view of the seat of the stool of FIG. 1.
Figure 13:
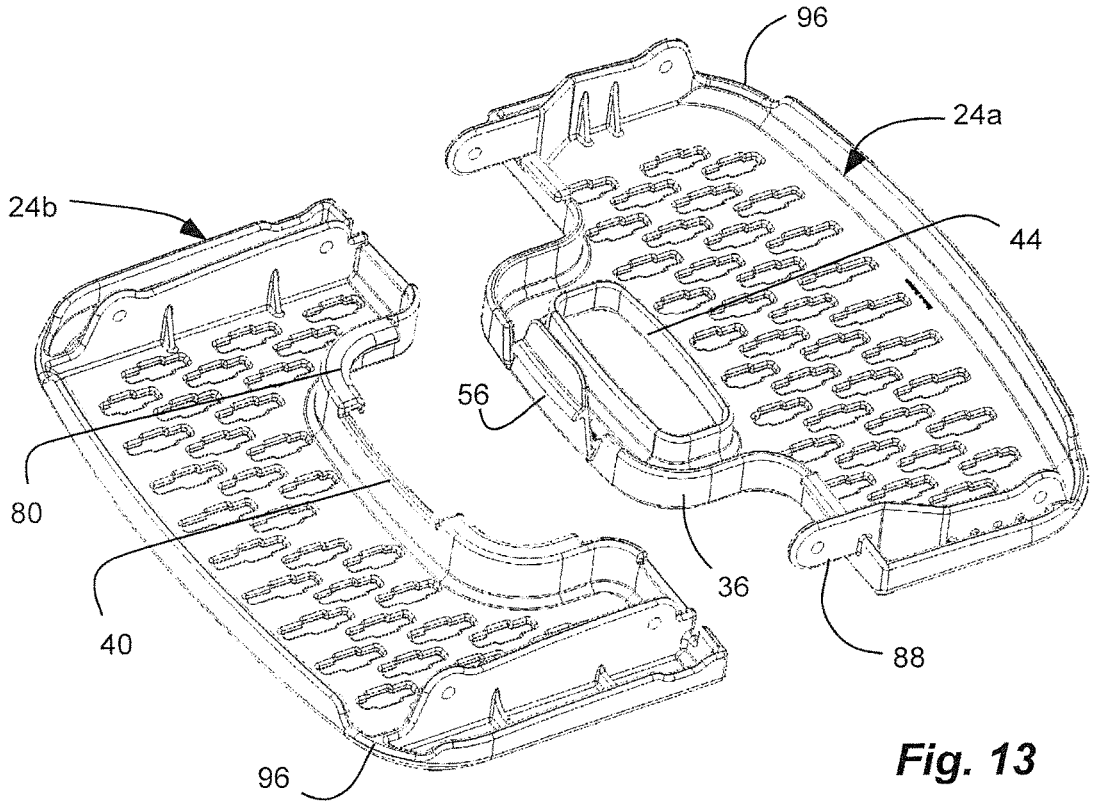
FIG. 13 is a bottom exploded perspective view of the seat of the stool of FIG. 1.
Figure 14:
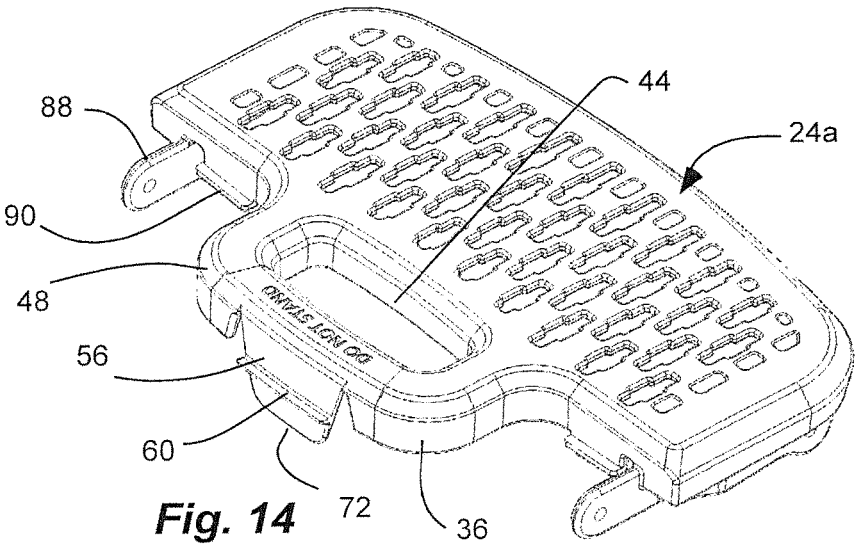
FIG. 14 is a top perspective view of a first seat portion of the set of the stool of FIG. 1.

The legs 14 (such as the first and second pairs of legs 14*a* and 14*b*, or the pairs of inner and outer legs) pivot between at least two orientations with respect to one another, including: 1) an open orientation, as shown in FIGS. 1*a* and 2*a*; and 2) a closed orientation, as shown in FIGS. 1*c* and 2*c*. In the open orientation, bottoms and tops of the legs are spaced-apart from one another a greater distance relative to the closed orientation. In addition, the legs can transverse one another, and can form an x-shaped profile. In the closed orientation, the bottoms and the tops of the legs are adjacent one another, or closer to one another relative to the open orientation. In addition, the legs are substantially coextensive, or the inner legs are disposed substantially or mostly within the outer legs, as shown in FIG. 2. In one aspect, the legs can be bent so that a bottom portion of the legs is off-set with respect to a top portion of the legs; so that the top and bottom portions of the legs are parallel, but not coaxial. Thus, the bottoms of the legs can be spaced-apart in the closed orientation (a lesser amount than in the open orientation), so that the stool can stand on the legs even in the closed orientation.

A seat 24 is pivotally coupled to and carried by the legs 14. The seat 24 is split or segmented into a pair of seat portions, such as first and second seat portions 24*a* and 24*b*. The pair of seat portions 24*a* and 24*b* is pivotally coupled together, and pivots with respect to one another about a seat axis 28. The seat or the seat portions can be formed of plastic, and can be formed by injection molding. The seat 24 of the pair of seat portions 24*a* and 24*b* has at least two orientations with respect to one another, including: 1) a seat orientation, as shown in FIGS. 1*a* and 2*a*; and 2) a folded orientation, as shown in FIGS. 1*c* and 2*c*. In the seat orientation, outer seating surfaces of the pair of seat portions 24*a* and 24*b* are co-planar and horizontal, and which also corresponds to the open orientation of the legs. In the folded orientation, the pair of seat portions 24*a* and 24*b* or outer seating surfaces thereof face in opposite directions, and are oriented substantially vertically, and which also corresponds to the closed orientation of the legs.

A part 32 (FIG. 5) can be formed between the seat portions 24*a* and 24*b*. The part 32 can be non-linear, or can be a non-linear part that extends non-linearly between the pair of seat portions when the pair of seat portions are in a seat orientation. A protrusion 36 can be formed in the first seat portion 24*a* that extends into an indentation 40 that can be formed in the second seat portion 24*b*, when the pair of seat portions are in the seat orientation. The indentation 40 and the protrusion 36 can form the non-linear part, or the non-linear part can form the indentation 40 and the protrusion 36. The part 32 can extend through an intermediate portion of the seat 24. The seat axis 28 can be vertically aligned with the protrusion 36 and the indentation 40 in the seat orientation (see FIG. 5). An aperture 44 can be formed in the protrusion 36 to define a handle 48 (FIGS. 1*c* and 6) when the pair of seat portions are in the folded orientation. Thus, the handle 48 can be formed in, and can be coextensive with, one of the pair of seat portions, namely the first seat portion 24*a*. The handle 48 can be flush with the seat 24 in the seat orientation, and can extend from the seat in the folded orientation. The handle 48 can be pivotal with respect to another of the seat portions, namely the second seat portion 24*b*.

A lock 52 positively holds the handle 48 of one seat portion (first seat portion 24*a*) with respect to another of the seat portions (second seat portion 24*b*) when the pair of seat portions are in the seat orientation. The lock 52 can be formed between the handle 48 of the first seat portion 24*a* and the second seat portion 24*b*. The lock 52 can be carried by the handle 48, and can engage the second seat portion 24*b* when the pair of seat portions are in the seat orientation. The lock 52 can comprise a tab 56 extending from the handle 48. The tab 56 can extend from an outermost perimeter or wall of the handle or protrusion, and can extend vertically downwardly in the seat orientation. A tooth 60 can extend from the tab 56, intermediate a length of the tab. The tooth 60 can extend outwardly and horizontally in the seat orientation. The tooth 60 can engage the second seat portion 24*b*, or wall or lip 62 (FIG. 9) thereof, in the seat orientation to lock the pair of seat portions from pivoting when the pair of seat portions are in the seat orientation. The tab 56 can be integrally formed with the seat 24 or handle 48, and can extend in a cantilever fashion from the handle or protrusion to form a leaf spring. The tab 56 can be flexible and displaceable to displace the tooth 60 away from the second seat portion 24*b* under an applied force. In addition, the tab 56 can be resilient and biased to return the tooth 60 into engagement with the second seat portion 24*b* upon removal of the applied force when the pair of seat portions are in the seat orientation. The tooth 60 can have an abutment side that is substantially perpendicular to the tab 56 and an engagement portion of the second seat portion 24*b*. In addition, the tooth 60 can have an opposite angled or inclined side that is inclined side that forms an oblique angle with respect to the tab. Thus, when the seat transitions from the folded orientation to the seat orientation, the angled or inclined surface of the tooth 60 can engage the second seat portion 24*b*, bending or deflecting the tab 56 away from the second seat portion until the seat portions are in the seat orientation and the tooth 60 clears the second seat portion, and then the resiliency of the tab 56 displaces the tooth 60 back towards the second seat portion so that the abutment side of the tooth engages the second seat portion. A distal end 72 of the tab 56 can extend beyond the tooth 60 to form a finger engagement configured to receive the applied force from a user's finger. Thus, a user can extend his or her hand, or fingers thereof, into the aperture 44, grasp the handle 48, and engage the finger engagement 72 of the tab 56 with the tip(s) of the fingers, apply a force to displace the tab 56 and thus the tooth 60 by pulling with the fingers, and lifting the handle 48 causing the stool to unlock and fold. Thus, the user can grasp the handle and deactivate the lock simultaneously with a single hand.

The first and second seat portions 24*a* and 24*b* can support one another in the seat orientation, and resist folding inwardly or downwardly. The second seat portion 24*b* can have a lip 80 or flange extending from the indentation 40 inwardly and towards the protrusion 36 or handle 48 in the seated orientation. The lip 80 can extend from a bottom of an inner wall forming the indentation and perimeter of the second seat portion. The protrusion 36 or handle 48, or perimeter wall thereof, can rest upon the lip 80 in the seat orientation. The first seat portion 24*a* can have a pair of arms 88 extending from the first seat portion towards the second seat portion 24*b* in the seat orientation. The second seat portion 24*b* can rest upon the pair of arms 88 in the seat orientation. In addition, a perimeter wall of the first seat portion 24*a* can also have a lip 90 or flange extending inwardly at the seam, and upon which the perimeter wall of the second seat portion 24*b* can rest in seat orientation.

As described above, the legs 14 can be pivotally coupled together, and the seat portions 24*a* and 24*b* can be pivotally coupled together, and the seat portions can be pivotally coupled to the legs. In one aspect, the tops of the legs 14 can be pivotally coupled to ribs in the seat or seat portions by fasteners, such as rivets or bolts, which can define pivot axes or axels 92 about which the seat portions pivot with respect to the legs. A four-bar linkage can be formed by the pair of seat portions 24*a* and 24*b* and the first and second pairs of legs. The four-bar linkage has four pivots (18, 28 and 92), and four bars defined between the pivots, and allows the linkage to pivot between the seat and folded orientations.

As described above, the seat 24 or the seat portions 24*a* and 24*b* can have an upper seating surface and a perimeter wall surrounding the seat and the seat portions. The perimeter wall can extend around a perimeter of the seat and the seat portions. Corner notches 96 can be formed in the perimeter wall at corners of the seat. The corner notches can extend into the perimeter wall. The corner notches 96 are capable of receiving the first and second pairs of legs 14*a* and 14*b* therein when the pair of seat portions are in the folded orientation. Thus, the corner notches allow the seat portions to fold closer together so that the seat and the stool has a reduced width in the folded orientation.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A foldable stool, comprising:

a) a first pair of legs spaced-apart from one another;

b) a second pair of legs spaced-apart from one another;

c) the first and second pairs of legs pivotally coupled together and pivoting with respect to one another about a leg pivot axis located at intermediate points along lengths of the first and second pairs of legs;

d) a seat pivotally coupled to and carried by the first and second pairs of legs;

e) the seat being split into a pair of seat portions, the pair of seat portions being pivotally coupled together and pivoting with respect to one another about a seat axis;

f) a non-linear part between the pair of seat portions extending non-linearly between the pair of seat portions when the pair of seat portions are in a seat orientation;

g) a protrusion in a first seat portion extending into an indentation in a second seat portion when the pair of seat portions are in the seat orientation;

h) an aperture formed in the protrusion defining a handle when the pair of seat portions are in a folded orientation;

i) a tab extending from the handle;

j) a tooth extending from the tab intermediate a length of the tab, the tooth engaging the second seat portion in the seat orientation to lock the pair of seat portions from pivoting when the pair of seat portions are in the seat orientation;

k) the tab being displaceable to displace the tooth away from the second seat portion under an applied force, and the tab being biased to return the tooth into engagement with the second seat portion upon removal of the applied force when the pair of seat portions are in the seat orientation; and l) a distal end of the tab extending beyond the tooth to form a finger engagement configured to receive the applied force.

2. The stool in accordance with claim 1, wherein the tab is flexible to displace the tooth away from the second seat portion under the applied force, and wherein the tab is resilient to return the tooth into engagement with the second seat portion upon removal of the applied force.

3. The stool in accordance with claim 1, further comprising:

a lip extending from the indentation and upon which the protrusion rests in the seat orientation.

4. The stool in accordance with claim 1, further comprising:

a pair of arms extending from the first seat portion and upon which the second seat portion rests in the seat orientation.

5. The stool in accordance with claim 1, wherein the seat axis is vertically aligned with the protrusion and the indentation in the seat orientation.

6. The stool in accordance with claim 1, wherein the pair of seat portions and the first and second pairs of legs form a four-bar linkage.

7. The stool in accordance with claim 1, further comprising:

a perimeter wall extending around a perimeter of the seat; and corner notches formed in the perimeter wall at corners of the seat capable of receiving the first and second pairs of legs therein when the pair of seat portions are in the folded orientation.

8. The stool in accordance with claim 1, wherein the first and second pairs of legs have at least two orientations with respect to one another, including:

a) an open orientation in which the first and second pairs of legs transverse one another, and with bottoms and tops of the first and second pairs of legs spaced-apart from one another; and b) a closed orientation in which the first and second pairs of legs are substantially coextensive, and with bottoms and tops of the first and second pairs of legs adjacent one another; and wherein the pair of seat portions have at least two orientations with respect to one another, including:

c) the seat orientation in which outer seating surfaces of the pair of seat portions are co-planar and horizontal, corresponding to the open orientation of the first and second pairs of legs; and d) the folded orientation in which the outer seating surfaces of the pair of seat portions face in opposite directions, and are oriented substantially vertically, corresponding to the closed orientation of the first and second pairs of legs.

9. A foldable stool, comprising:

a) legs pivotally coupled together and pivoting with respect to one another about a leg pivot axis located at an intermediate length of the legs, the legs pivoting between an open orientation in which bottoms and tops of the legs are spaced-apart from one another, and a closed orientation in which the bottoms and the tops of the legs are adjacent one another;

b) a seat pivotally coupled to and carried by the legs;

c) the seat being split into a pair of seat portions, the pair of seat portions being pivotally coupled together and pivoting with respect to one another about a seat axis, the pair of seat portions pivoting between a seat orientation in which outer seating surfaces of the pair of seat portions are co-planar, and a folded orientation in which the pair of seat portions face in opposite directions;

d) a handle formed in and coextensive with one of the pair of seat portions, and the handle being pivotal with respect to the other of the pair of seat portions; and e) a lock positively holding the handle with respect to the other of the pair of seat portions when the pair of seat portions are in the seat orientation.

10. The stool in accordance with claim 9, wherein the lock is formed between the handle of the one of the pair of seat portions and the and of the pair of seat portions.

11. The stool in accordance with claim 9, wherein the lock is carried by the handle and engages the other of the pair of seat portions when the pair of seat portions are in the seat orientation.

12. The stool in accordance with claim 9, wherein the lock comprises:

a) a flexible tab extending from the handle;

b) a tooth extending from the tab intermediate a length of the tab, the tooth engaging the second seat portion in the seat orientation to lock the pair of seat portions from pivoting when the pair of seat portions are in the seat orientation;

c) the tab being flexible to displace the tooth away from the second seat portion under an applied force, and the tab being resilient to return the tooth into engagement with the second seat portion upon removal of the applied force when the pair of seat portions are in the seat orientation; and d) a distal end of the tab extending beyond the tooth to form a finger engagement configured to receive the applied force.

13. The stool in accordance with claim 9, further comprising:

a non-linear part disposed between the pair of seat portions extending non-linearly between the pair of seat portions when the pair of seat portions are in the seat orientation.

14. The stool in accordance with claim 9, further comprising:

a) a protrusion in the first seat portion extending into an indentation in the second seat portion when the pair of seat portions are in the seat orientation; and b) an aperture formed in the protrusion defining the handle.

15. The stool in accordance with claim 14, further comprising:

a lip extending from the indentation and upon which the protrusion rests in the seat orientation.

16. The stool in accordance with claim 14, further comprising:

a pair of arms extending from the first seat portion and upon which the second seat portion rests in the seat orientation.

17. The stool in accordance with claim 14, wherein the seat axis is vertically aligned with the protrusion and the indentation in the seat orientation.

18. The stool in accordance with claim 9, wherein the pair of seat portions and the pairs of outer and inner legs form a four-bar linkage.

19. The stool in accordance with claim 1, further comprising:

a perimeter wall extending around a perimeter of the seat; and corner notches formed in the perimeter wall at corners of the seat capable of receiving the legs therein when the pair of seat portions are in a folded orientation.

20. A foldable stool device, comprising:

a) a pair of outer legs spaced-apart from one another;

b) a pair of inner legs spaced-apart from one another;

c) the pairs of outer and inner legs pivotally coupled together and pivoting with respect to one another about a leg pivot axis located at an intermediate point along a length of the pairs of outer and inner legs, with the pair of inner legs passing inside of the pair of outer legs, the pairs of outer and inner legs having at least two orientations with respect to one another, including:

i) an open orientation in which the pairs of outer and inner legs transverse one another, and with bottoms and tops of the pairs of outer and inner legs spaced-apart from one another; and ii) a closed orientation in which the pairs of outer and inner legs are substantially coextensive, and with bottoms and tops of the pairs of outer and inner legs adjacent one another;

d) a seat pivotally coupled to and carried by the tops of the pairs of outer and inner legs;

e) the seat being segmented into a pair of seat portions along a part between the pair of seat portions, the pair of seat portions being pivotally coupled together and pivoting with respect to one another about a seat axis, the pair of seat portions having at least two orientations with respect to one another, including:

i) a seat orientation in which outer seating surfaces of the pair of seat portions are co-planar and horizontal, corresponding to the open orientation of the pairs of outer and inner legs; and ii) a folded orientation in which the outer seating surfaces of the pair of seat portions face in opposite directions, and are oriented substantially vertically, corresponding to the closed orientation of the pairs of outer and inner legs;

f) the part between the pair of seat portions extending non-linearly with a protrusion in a first seat portion extending into an indentation in a second seat portion when the pair of seat portions are in the seat orientation;

g) the indentation having a lip upon which the protrusion rests in the seat orientation;

h) a pair of arms extending from the first seat portion at the part and upon which the second seat portion rests in the seat orientation;

i) the seat axis being vertically aligned with the protrusion and the indentation in the seat orientation;

j) an aperture formed in the protrusion defining a handle in the folded orientation;

k) a tab extending from the protrusion;

l) a tooth extending from the tab intermediate a length of the tab, the tooth engaging the second seat portion in the seat orientation to lock the pair of seat portions in the seat orientation;

m) the tab being flexible to displace the tooth away from the second seat portion under an applied force, and the tab being resilient to return the tooth into engagement with the second seat portion upon removal of the applied force; and n) a distal end of the tab extending beyond the tooth in the seat orientation to form a finger engagement configured to receive the applied force.

* * * * *